United States Patent [19]

Wainberg

[11] 4,265,372

[45] May 5, 1981

[54] CONTAINER AND DISPENSER-CUTTER UNIT COMBINATION FOR CONTAINING AND HOLDING DETACHABLE FLEXIBLE FORM-FILL-SEAL PLASTIC POUCHES

[76] Inventor: Lawrence Wainberg, 66 Forden Crescent, Westmount, Montreal, Quebec, Canada, H3Y 2Y4

[21] Appl. No.: 25,728

[22] Filed: Mar. 30, 1979

[51] Int. Cl.[3] ..... B67B 7/28

[52] U.S. Cl. ..... 222/82; 222/85; 222/94

[58] Field of Search ..... 222/80–91, 222/94, 105, 136, 183; 206/222; 128/218 M, 272.1

[56] References Cited

U.S. PATENT DOCUMENTS

| | | | |
|---|---|---|---|
| 3,024,947 | 3/1962 | Jeynes | 222/83.5 |
| 3,239,104 | 3/1966 | Scholle | 222/81 |
| 3,339,802 | 9/1967 | Weiner et al. | 222/82 |
| 3,424,346 | 1/1969 | Fruehling | 222/82 X |
| 3,608,782 | 9/1971 | Sathicq | 222/136 X |
| 3,655,096 | 4/1972 | Easter | 222/82 |
| 3,762,606 | 10/1973 | Lande | 222/88 |
| 3,838,796 | 10/1974 | Cohen | 222/105 |
| 3,938,707 | 2/1976 | Schmit | 222/183 X |

*Primary Examiner*—F. J. Bartuska
*Attorney, Agent, or Firm*—Browdy & Neimark

[57] ABSTRACT

A container and dispenser-cutter unit combination for containing and holding therein at least one or more flexible form-fill-seal plastic pouches adapted to contain commodities such as fluids, granules and the like, in which a container has a dispenser-cutter unit forming a closure lid for the opened end of the container and is adapted to contain and hold a detachable flexible form-fill-seal plastic pouch. An externally threaded spout forms an integral part of the closure lid and projects outwardly therefrom and is adapted to be engaged by a screw-cap. The cutter unit is formed of a circular knife made integral with the underside of the closure lid and projects inwardly therefrom and is located within the orbit of the spout and has its lower portion terminating into a pouch cutting edge.

5 Claims, 22 Drawing Figures

CONTAINER AND DISPENSER-CUTTER UNIT COMBINATION FOR CONTAINING AND HOLDING DETACHABLE FLEXIBLE FORM-FILL-SEAL PLASTIC POUCHES

The invention relates to improvements in a container and dispenser-cutter unit combination for containing and holding flexible form-fill-seal plastic pouches adapted to contain fluids, granules and the like, as described in the present specification and illustrated in the accompanying drawings that form a part of the same.

The invention consists essentially in the novel features of construction as pointed out broadly and specifically in the claims for novelty following a description containing an explanation in detail of an acceptable form of the invention and modifications thereof.

It has been common practice to merchandise fluids, granules, food products, oils, beverages, anti-freeze and the like, in seal containers, bags and pouches and which are made from flexible materials such as cellulosics, glassine, polyvinyl chloride, polystyrene, copolymer film, polyethylene and the like and distributed to the consumer, who destroys or otherwise opens the sealed bag or pouch for releasing its contents therefrom.

In the packaging and merchandising of certain commodities, flexible sealed plastic pouches containing fluids, granules and the like are generally used, and the consumer or other person stores away the fill-seal pouches until required. When a fill-seal pouch is needed, the consumer places the pouch in an upright position into a pitcher or jug, nips off one upper corner of the pouch to form a flow outlet and simply tilts the pitcher and pours out a specified quantity of the contents of the pouch, the pitcher, with its open pouch, which now acts as a liner therein, is stored away until further required.

In other instances, fluids such as milk, have been poured into form-fill-seal pouches and are automatically or manually inserted into moisture-proof sealed cartons. When the consumer desires a glass of milk to drink, he cuts and tears off the top corner of a milk carton to expose the sealed milk pouch contained therein, and then snips off, pierces or otherwise penetrates the skin of the pouch to form an aperture therethrough, and which is in line with the torn or cut-off corner of the carton. The consumer may then withdraw the milk from the pouch and through the pouch opening, by means of a hollow straw or pours out the milk into a glass or other receptacle. The used carton and pouch are then discarded.

Some attempts have been made to provide a pouch receptacle in the shape of a pitcher, an open-top can and the like, in which each bottom wall of the receptacle is formed with an aperture and a flow pipe extending therethrough and integrally or otherwise secured to the bottom wall of the receptacle. The upper end portion of the flow pipe terminates into a cutting edge while its lower end portion is adapted to engage with the inlet of a radiator, fuel tank, oil inlet of vehicle engines and other equipment.

In this type of receptacle, depending on the kind of fluids it is used for, such as anti-freeze, the attendant or other person will drop a flexible seal-plastic pouch containing antifreeze, into the open top or mouth of the receptacle and insert the lower portion of the flow pipe into the feed inlet of the engine's radiator and maintain the receptacle in that position. The attendant then presses downwardly on the top portion of the flexible pouch so as to impinge the pouch upon the cutting edge of the upper portion of the cutting edge of the flow pipe, thereby causing a rupture to the bottom portion of the pouch and effecting a flow of the contents from the pouch through the flow pipe and into the feed inlet of the radiator of the engine.

The use of these flexible plastic seal pouches for containing fluids and other products has been found very efficient, inasmuch that they have created a breakthrough in terms of cost, durability and convenience in the packaging of fluids and other products. Furthermore, these pouches are light in weight and take less space in refrigeration, less storage space and on display stands, shelving and the like, and do away with the handling of bottles and their awkward disposal.

However, there is much to be desired in the lack of a proper receptacle in which to place the filled pouch, in most cases, the filled pouch is simply inserted into a pitcher or jug, one top corner of the pouch is cut off to form an aperture for the purpose of pouring out the required volume of the fluid from the pouch. Once the pouch has been opened, it allows the surrounding air and foreign matter to enter the pouch through the aperture and permeate the contents of the pouch. Furthermore, no means are provided to maintain the receptacle closed at all times if needed, or any means for manually, semi-automatically or otherwise penetrating and forming an aperture through the skin of the flexible fluid form-fill-seal plastic sealed pouch for the egress of its contents without mutilating the flexible pouch.

It is therefore, the purpose of this invention to avoid such defects or other shortcomings of previous means and methods in packaging and merchandising of these flexible fluid or other commodity form-fill-seal plastic pouches, by devising a container and a dispenser-cutter unit that form an indispensable part of one another, and a flexible fluid or other commodity form-fill-seal plastic pouch which is adapted to be detachably inserted and held in the container and to be manually, semi-automatically or otherwise operated by the dispenser-cutter unit to form an aperture through the pouch for the withdrawal of the contents.

Among the objects of the invention is to devise a mean whereby the use of flexible form-fill-seal plastic pouches, which are used for containing milk, cream, soft drinks, fruit juices, oils, anti-freeze and the like, are handled, packaged and utilized in a more efficient manner. Furthermore, such means lend themselves to packaging and handling a wider range of products, such as detergents, pharmaceuticals, viscous and fluid products, laboratory materials, air sprays, perfumes, deodorants, antiperspirants, topical antiseptics, and innumerable other products.

Another object of the invention is to devise a means whereby the combined container and dispenser-cutter unit will hold a removable flexible form-fill-seal plastic pouch in an upright position inserted in the container and manually, semiautomatically or otherwise operated to form an aperture through one side of the plastic pouch and permit a specified volume of its contents to be withdrawn therefrom, and then close any outlets leading from the container or dispenser.

Still another object is to maintain the flexible pouch and its contents in a closed container and minimize the possibility of any moisture, air, foreign matters, odors and the like from contaminating the pouch contents.

Other and further advantages and improvements of the invention will be readily understood and appreciated from the description of the device and its operation set forth in the specification below when read in connection with the drawings illustrating various embodiments of the invention.

In the following description, and in the claims, various details will be identified by specific names for convenience; the names, however, are intended to be generic in their application.

In the description of the figures in the drawings, the contents of the flexible form-fill-seal plastic pouches has been defined for the packaging of fluids for the purpose of the explanation of the use of the invention, but it is to be understood that the contents of the flexible plastic pouch may be granules and other commodities that may be desirable to package.

IN THE DRAWINGS

Figure 18:
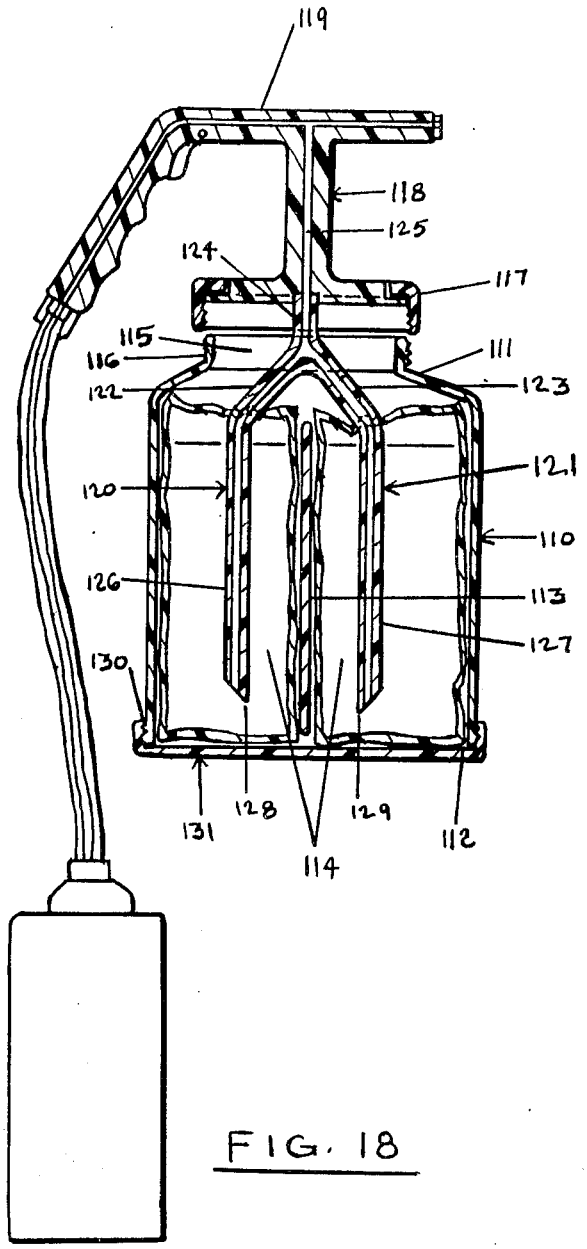

FIG. 18 is a sectional schematic view of a modification of the invention, in which the container is adapted to hold multiple flexible fluid form-fill-seal plastic pouches therewithin and the dispenser-cutter unit is provided with suction tubes which terminate into pouch cutting edges adapted to pierce and penetrate the skin of the flexible fluid form-fill-seal plastic pouches for withdrawing the contents of the pouches.

Figure 19:
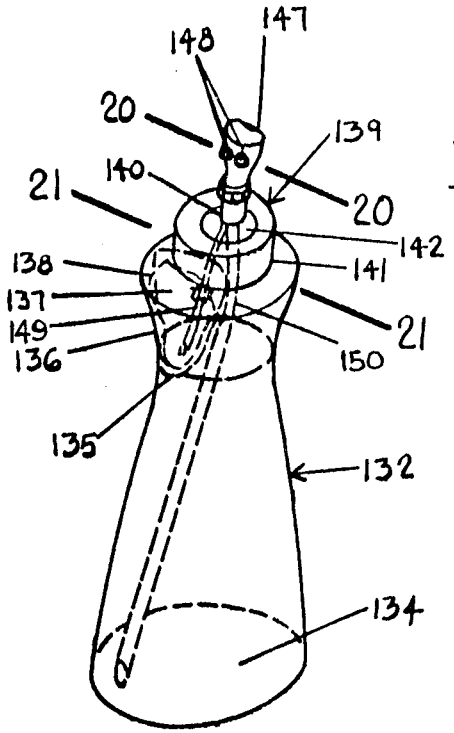

FIG. 19 is a perspective schematic view of a modification of the invention in which the container has a separate compartment to hold a flexible fluid form-fill-seal pouch and the remainder of the space contained in the container forming a separate compartment which is adapted to contain a different fluid, and a dispenser-cutter unit combination including a metering valve forming a closure for the container.

Figure 20:
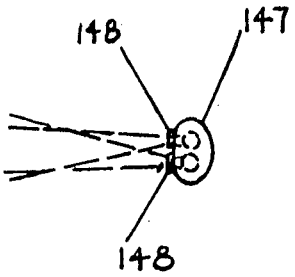

FIG. 20 is a cross-sectional view as taken along the line 20—20 in FIG. 19.

Figure 21:
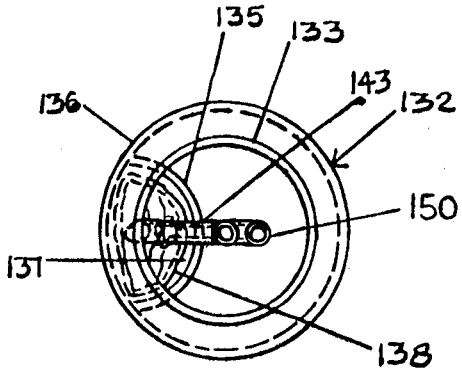

FIG. 21 is a cross-sectional view as taken along the line 21—21 in FIG. 19.

Figure 22:
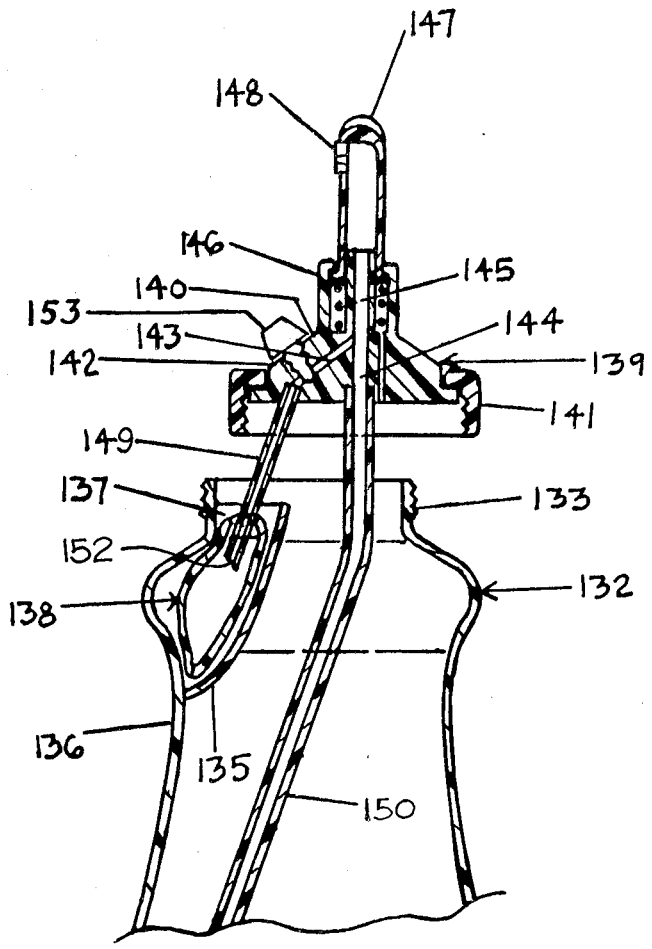

FIG. 22 is an enlarged fragmentary sectional view of the invention as illustrated in FIG. 19, with the exception that the metering valve unit meters only the flow of the fluid withdraw from the flexible fluid form-fill-seal pouch.

Like numerals of reference indicate corresponding parts in the various figures.

Referring to the drawings, the container and dispenser-cutter unit combination form an indispensable part of one another for containing, holding and perforating flexible form-fill-seal plastic pouches adapted to contain fluids, granules, concentrates and the like, consists of a container as indicated by the numeral 35, preferably made from a rigid or semi-rigid plastic material or their equivalents, which has an open end 36, the surrounding edge of which terminates in a locking lip 37. The contour of the container 35 may be rectangular, circular or any other shape to conform with the configuration and location of a detachable flexible form-fill-seal plastic pouch 38 containing the specified product and to hold and retain the detachable pouch in position therein.

The dispenser-cutter unit 39 is formed of a movable lid 40 hingedly secured at 41 to the upper portion of the container 35 situated adjacent to its open end and has a circumferential downwardly projecting locking lip 42 which is adapted to interlock with the locking lip 37 of the container 35. A circular shaped spout 43 forms an integral part of the lid 40 and projects outwardly therefrom and is externally threaded at 44 for engagement by the internally threaded screw cap 45. The spout 43 is located adjacent to the circumferential edge of the container 35 and is situated opposite to the position taken by the hinge 41 connecting the lid and container to one another.

The pouch cutter unit or circular knife 46 is made integral with the underside of the lid 40 and projects inwardly therefrom and is located within the orbit of the circular shaped spout 43 and has its lower portion 47 terminating into a circular cutting edge 48.

In order to minimize the possibility of any leakage from the container and dispensing unit, a gasket 49 or its equivalent is secured between the locking lip 37 of the container and the projecting locking lip 42 of the hinge lid 40 to form a tight joint and to prevent leakage when the lid is closed and interlocked with the container.

In the use of this invention, the container has a hinged dispenser-cutter unit forming a closure lid for the open end of the container. When the closure lid is in its open position, the flexible commodity form-fill-seal plastic pouch is inserted, in an upright position, into the open end of the container, the lid is then hingedly lowered to its close position.

Before the closure lid comes in contact with the container, the screw cap 45 is brought into engagement with the spout 43 of the lid and closes the passageway thereof so as to prevent any fluids or granules escaping therethrough as the pouch cutter is brought into cutting contact with the wall of the flexible plastic pouch. As the closure lid is brought into interlocking engagement with the container, the cutter-knife penetrates the wall of the pouch and creates an aperture therethrough whih is in alignment with the spout of the lid. The container and the closure lid are interlocked with one another and the pouch is locked within the container and engaged by the closure lid.

When it is required to use the contents of the pouch, the screw cap is simply removed from the spout of the lid. The container is tilted in an ordinary way and the contents of the pouch is removed by gravity flow. When the desired quantity of the contents has been removed from the pouch, the container is placed in an upright position, the screw cap is applied to the spout and the container is stored away for further use.

When the contents of the pouch has been depleted, the pouch is removed from the container and replaced by another flexible commodity form-fill-seal plastic pouch.

Figure 1:
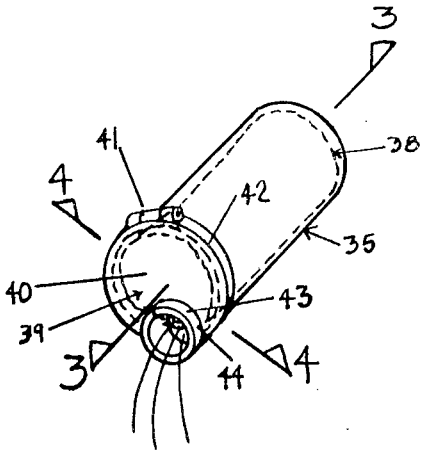
FIG. 1 is a perspective view of the container and dispenser-cutter unit combination, containing the fluid form-fill-seal plastic pouch, and tilted at a pouring angle to allow the fluid to flow therefrom.
Figure 2:
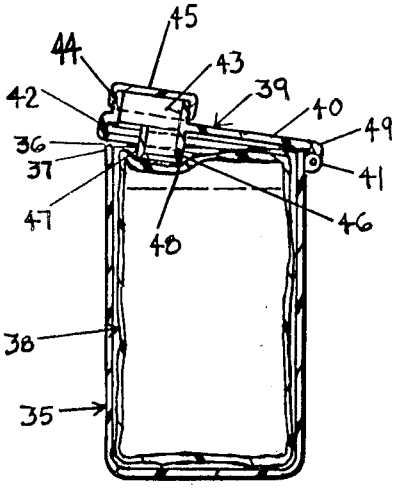
FIG. 2 is a vertical sectional view of the container and dispenser-cutter unit is hingedly secured to the open end of the container, which contains the flexible fluid form-fill-seal pouch, and the cutter portion of the unit in position to penetrate and puncture the flexible plastic pouch.
Figure 3:
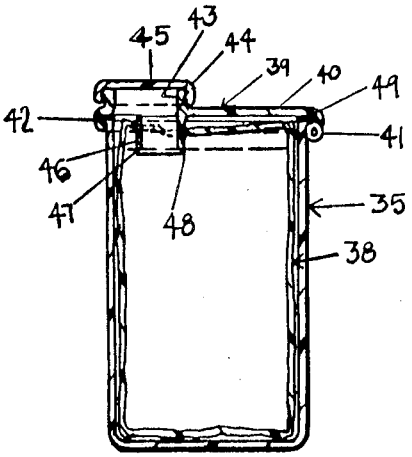
FIG. 3 is a vertical sectional view of the container and its dispenser-cutter unit combination as shown in FIG. 2, but illustrating the position of the dispenser-cutter unit after it has pierced the pouch held within the container.
Figure 4:
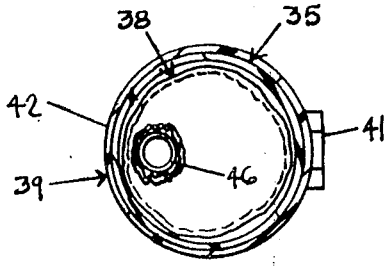
FIG. 4 is a plan sectional view of the container and dispenser-cutter unit with the cutter portion puncturing the fluid form-fill-seal plastic pouch held in the container.
Figure 5:
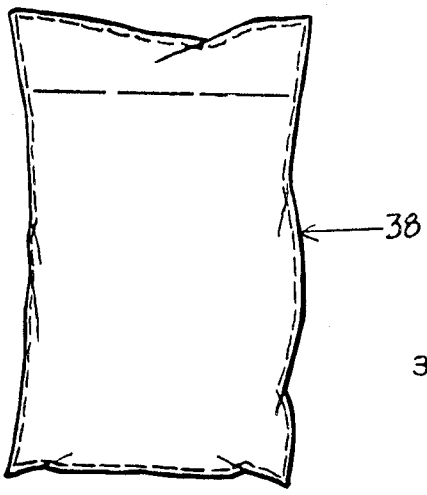
FIG. 5 is a front elevation of a flexible fluid form-fill-seal plastic pouch.
Figure 6:
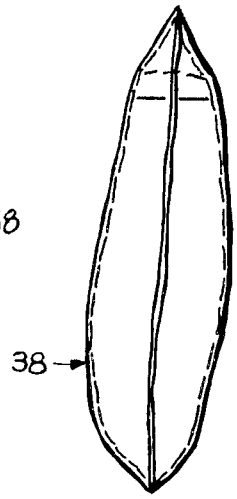
FIG. 6 is a side elevation of the flexible fluid form-fill-seal plastic pouch.
Figure 7:
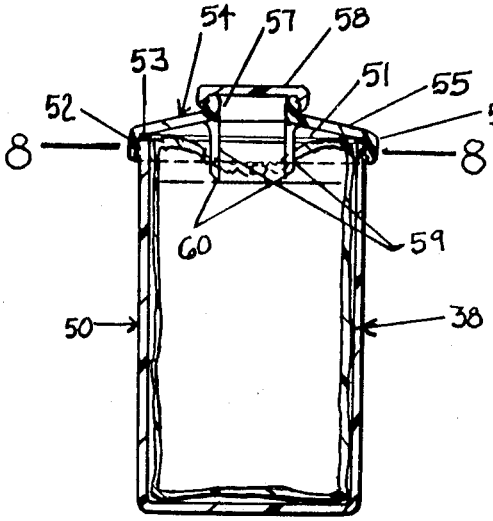
FIG. 7 is a vertical sectional schematic view as a modified form of the invention as shown in FIG. 2, illustrating a screw type of dispenser closure provided with a center-spout and pouch cutter version.
Figure 8:
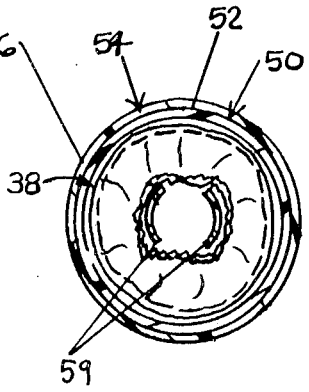
FIG. 8 is a cross-sectional view as taken along the line 8—8 in FIG. 7.

In FIGS. 7 and 8 there is illustrated a slight deviation of the invention in which the container 50 has an open end 51 and is circumferentially threaded externally at 52 adjacent to the circumferential edge 53. The dispenser-cutter unit 54 is in the form of a screw lid 55 having an internally threaded circumferential flange 56 which is adapted to engage or disengage with the externally threaded open end of the container.

An externally threaded neck-shaped spout 57 is formed integral with the screw lid 55 and projects upwardly therefrom and is centrally located thereon and forms a passageway therethrough, the spout being adapted to be engaged by the screw cap 58. Arcuate-shaped opposing cutter-knives 59 are integral or otherwise secured to the underside of the screw lid 55 and are approximately in alignment with the neck-shaped spout 57 of the screw lid 58.

In the use of this invention, as illustrated in FIGS. 7 and 8, the flexible commodity form-fill-seal plastic pouch is inserted in an upright position into the open end of the container and held therein. The screw lid has its spout closed by the screw cap prior to the tightening of the screw lid upon the threaded open end of the container and placing the position of the lower cutting ends 60 of the arcuate-shaped knives slightly above the top surface of the flexible commodity form-fill-seal plastic pouch. When it is required to use the contents of the pouch, the screw lid is further tightened to interlock the screw lid with the threaded open end of the container, thereby causing the arcuate-shaped knives to engage and penetrate the top surface of the flexible commodity form-fill-seal plastic pouch and effect an aperture therethrough and to remain in that position until the pouch has been relieved of its contents. The screw cap is then removed from the spout of the screw lid and the container is then handled like any other container that is provided with a spout or discharge opening. When the pouch has been emptied, the screw lid is unscrewed from the open end of the container, and permitting the empty pouch to be removed and detached from the container and the dispenser-cutter unit combination.

The combined container and dispenser-cutter unit, may then be refilled with another flexible commodity form-fill-seal plastic pouch and handled and used in the same manner as the previous emptied flexible plastic pouch. In many instances, this being accomplished without the need of re-cleaning the combined container and dispenser-cutter unit.

Figure 9:
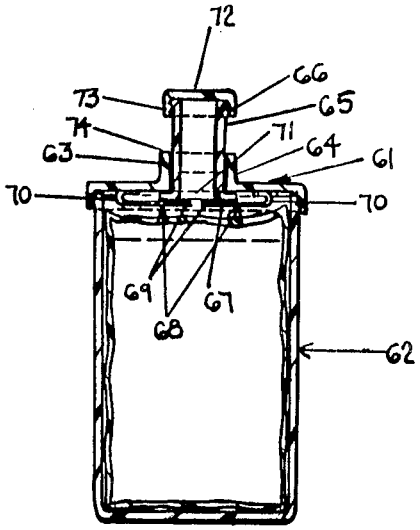
FIG. 9 is a vertical sectional schematic view of a modified form of the invention as shown in FIG. 7, illustrating the screw type of dispenser closure provided with a plunger type of spout adapted to engage with pouch-cutters, forming a part of the dispenser, and to cause the movable pouch-cutters to spread apart from one another and penetrate and split the pouch held within the container.
Figure 10:
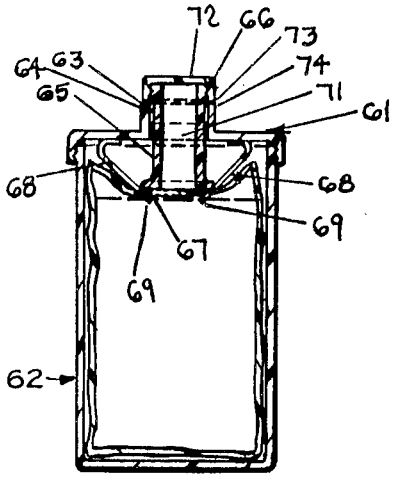
FIG. 10 is a vertical sectional schematic view of the invention as illustrated in FIG. 9 and showing the movable pouch-cutters puncturing through the wall of the pouch to form an orifice therethrough.

In FIGS. 9 and 10 an alternative means and method of utilizing the cutter-knives and the spout of the container is illustrated, in which the container 62 has an open externally threaded end and the screw lid 61 of the container 62 has a commodity discharge aperture 63 surrounded by a spout 64 that is integral with the screw lid 61 and extends upwardly therefrom. A plunger 65 is reciprocally mounted in and through the integrally secured spout 64 and extends beyond the open ends thereof. The upper end portion of the plunger 65 is externally threaded at 66 while its lower portion terminates in an outwardly projecting circumferential flange 67 adapted to engage and disengage with the undersurface of the screw-lid and situated adjacent to the commodity discharge aperture 63, which is in alignment with the spout 64.

The swingably hook-shaped resilient cutter knives 68 are in the form of blades which terminate into cutter edges 69 located within the container 62, and have their hook portions 70 integrally or otherwise secured to the underside of the screw lid 61 adjacent to and on opposing sides of the spout 64. In the non-pouch-cutting position of the resilient cutter knives 68, the blades thereof extend inwardly and in approximately longitudinal alignment towards one another and are engaged by the projecting circumferential flange 67 of the hollow plunger 65, the pouch cutting end portions of the blades terminating short from one another below the commodity flow area passageway 71 of the plunger 65. The upper end of the plunger 65 is closed by the screw cap 72, which, upon the application of a down pressure on the plunger 65 the lower circumferential edge 73 of the screw cap will come into direct engagement with the upper circumferential edge 74 of the spout 64.

In the operation of the modification, the flexible commodity form-fill-seal pouch is inserted in an upright position into the open end of the container and the screw lid, having its plunger closed by the screw cap, is threaded upon the threaded open end of the container and thus closing the container.

The plunger is freely mounted in its limited reciprocal motion in relation to the container and dispenser and is used in the operation of the cutter-knives. When the plunger is pressed downwardly, it will apply pressure upon the resilient cutter knives causing them to swing downwardly and engage and penetrate the top surface of the pouch and forming an aperture therethrough. When pressure is released, the screw cap may be removed, the container tilted and the required quantity of the contents will pour out through the aperture made in the pouch. The screw cap is then replaced on the hollow plunger and the combination container-dispenser-cutter unit assembly may be stored away until needed.

In this way, the container and dispenser-cutter unit together with the flexible pouch become a combination and are maintained in that position until the commodity has been completely withdrawn from the pouch. The screw lid is then disengaged from the container, and replaced by another flexible commodity form-fill-seal plastic pouch.

Figure 11:
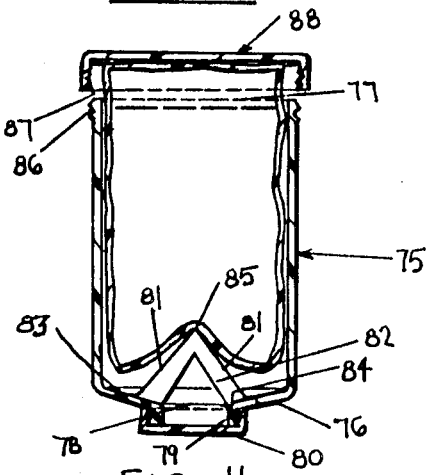
FIG. 11 is a vertical sectional schematic view of the invention in which the flexible fluid form-fill-seal plastic pouch is inserted through one end of the container for engagement with the dispenser-cutter unit located at the other end of the container.
Figure 12:
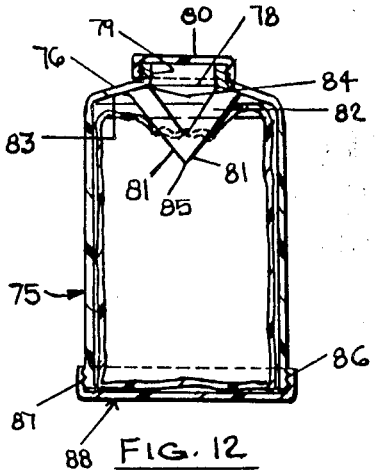
FIG. 12 is an inverted vertical sectional schematic view of the invention, as shown in FIG. 11 and in which the flexible fluid form-fill-seal pouch has been pierced by the dispenser-cutter unit, and capped, and the contents thereof ready to be poured.

A modification of the invention is illustrated in FIGS. 11 and 12, in which the container 75 is formed of a rigid plastic or equivalent material and has an internal closed end 76 and an open end 77. The closed end 76 has a commodity discharge aperture 78 surrounded by an externally threaded spout 79 that is integral with the closed end 76 and projects upwardly therefrom and is adapted to be engaged by an internally threaded closure cap 80.

The cutter-knives 81 of the container dispenser-cutter unit 82 are integral or otherwise secured to the underside 83 of the closed end 76 of the container and are located adjacent to the inner circumferential edge 84 of the spout and extend downwardly and inwardly therefrom into the container to complete a V-shaped cutting edge point 85 and positioned below the commodity discharge aperture 78 and in an approximate central location of the inner area of the spout 79.

The container 75 is provided with an integral circumferential outerlocking lip unit 86 located adjacent to its open end 77 and which is adapted to be engaged by the inner circumferential locking lip 87 of the snap closure lid 88.

The use and application of this modified form of the invention, as shown in FIGS. 11 and 12, is similar to the forms previously described with the exception that the flexible commodity form-fill-seal plastic pouch is inserted through one end of the container and the contents of the pouch withdrawn through the opposing end of the container.

When inserting a flexible commodity form-fill-seal plastic pouch into the container, the closure cap is applied to the open spout of the closed end of the container. The filled pouch is then inserted through the open end of the container and has one end resting on the V-shaped point of the cutter-knives while the other end portion of the pouch projects beyond the open end of the container. The closure lid is applied to the open end of the container and is brought into pressure contact with the exposed end portion of the pouch and forces it to be impinged upon the V-shaped cutting points of the cutter-knives which penetrate the pouch and cuts it open to permit the withdrawal of the commodity therein. Simultaneously, the closure lid is snapped into interlocking engagement with the open end of the container and thereby sealing the contents therein until required.

When some of the commodity contents is to be withdrawn from the closed container, the closure cap is removed from the spout of the container and a specified volume of the commodity is poured out in the usual way. The spout of the container is then recapped, the closed container is then stored away until further required.

Figure 13:
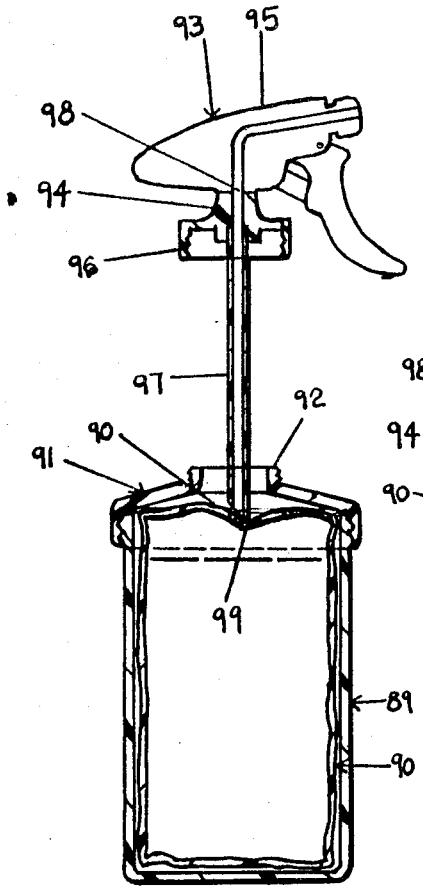
FIG. 13 is a vertical sectional schematic view of the invention in which the dispenser is formed with a sprayer and closure cap and provided with a hollow tube having its lower end terminating into a cutting edge adapted to engage and penetrate the top portion of the flexible fluid form-fill-seal plastic pouch held within the container.
Figure 14:
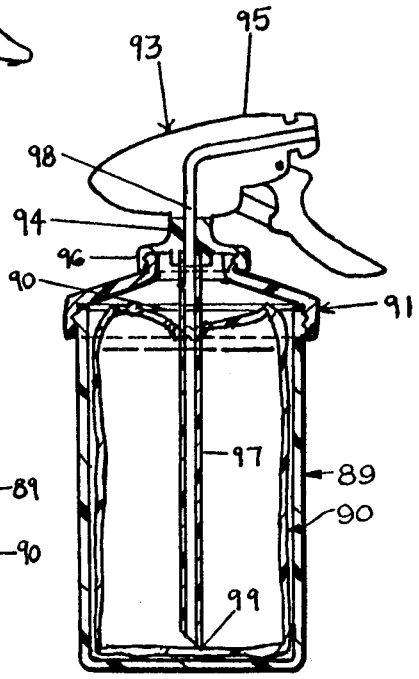
FIG. 14 is a vertical sectional schematic view of the invention, as shown in FIG. 13, in which the flexible fluid form-fill-seal plastic pouch has been pierced by the dispenser-cutter unit and capped, and the contents thereof ready to be withdrawn therefrom.

In FIGS. 13 and 14 the rigid container 89 is similarly constructed to the container as illustrated in FIG. 7, and has an open end 90 and is adapted to be closed and opened by the screw lid 91. The screw lid has an externally threaded spout 92 projecting upwardly therefrom and integrally secured thereto and adapted to be engaged and disengaged by the dispenser-cutter unit 93, which is in the form of a top-fill dispenser 94 operated by the sprayer suction pump 95 thereof and integrally mounted on a screw cap 96. A suction tube 97 is integrally or otherwise secured to the underside of the screw cap 96 and connected to passageway 98 of dispenser 94, the free end of the suction tube terminating into a pouch cutter 99.

The flexible commodity form-fill-seal plastic pouch is inserted into the container in the usual way, and the dispenser-cutter unit is placed into aligned position with the spout of the screw lid so that upon pushing down the dispenser-cutter unit the suction tube will be pushed through the orifice of the spout and then into and through the skin of the flexible commodity form-fill-seal plastic pouch until the end portion of the suction tube terminates short of the bottom of the pouch and the screw cap is engaged with the threaded spout and forms the closure.

In this way, the commodity is always sealed within the container, until the contents has been used up. The screw lid and its dispenser-cutter unit are then detached from the container, the used spout removed and replaced by another flexible commodity form-fill-seal plastic pouch, and the dispenser-cutter unit is returned to its closure position on the container.

Figure 15:
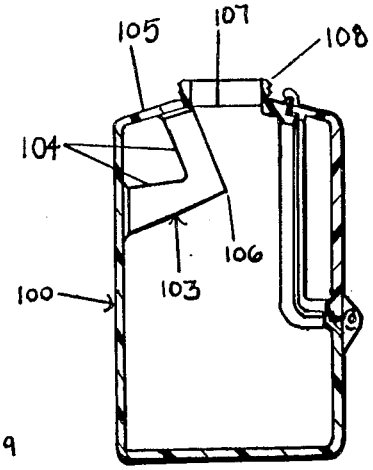
FIG. 15 is a vertical sectional schematic view and a modified form of the invention, in which the flexible form-fill-seal plastic pouch is inserted in the container through one side thereof and pressed inwardly therein by the closure of the dispenser for engagement with the cutter unit secured to the opposing inner side of the container.
Figure 16:
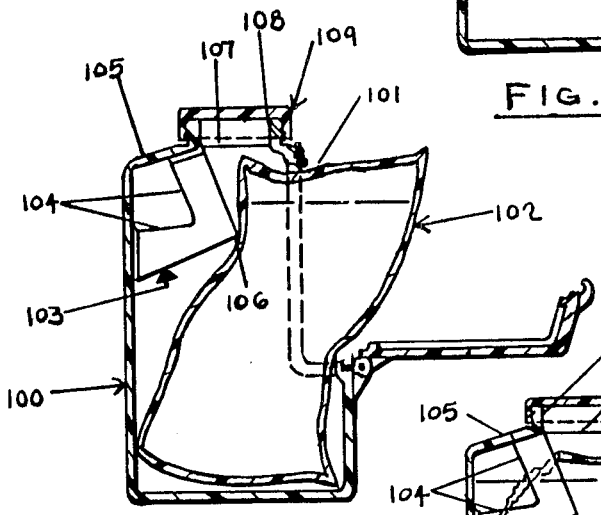
FIG. 16 is a vertical sectional schematic view of the invention as illustrated in FIG. 15 and showing the pouch inserted in the container and in contact with the cutter unit therewithin.
Figure 17:
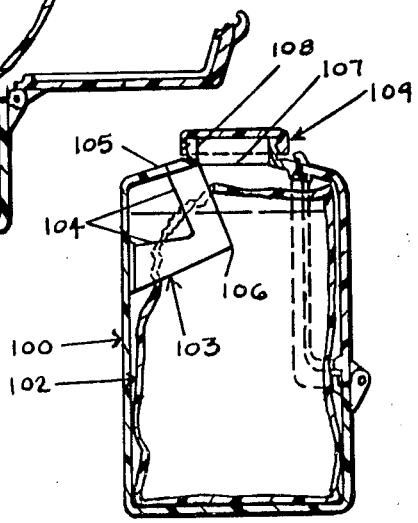
FIG. 17 is a vertical sectional schematic view of the invention, as illustrated in FIGS. 15 and 16, showing the pouch held within the container pierced by the cutter unit, the dispenser closed and the contents of the pouch ready to be withdrawn therefrom.

In FIGS. 15, 16 and 17 the self-contained container dispenser-cutter unit combination are all preferably integrally connected with one another, in which the container 100 has a dispenser side fill entrance 101 for the insertion and removal of the flexible commodity form-fill-seal plastic pouch 102 and a side hinge closure wall 102(*a*) forming a part of the container and adapted to open or tightly close the dispenser side fill entrance 101.

The cutter-knife 103 is preferably formed in a V-shape and the cutter arms 104 of the V-shaped knife 103 is welded or otherwise secured to the inner surfaces of said container such as the inner side portion of the container that is facing the dispenser side fill entrance 101 and to the underside of the integral top wall 105 of the container. The apex 106 of the V-shaped knife terminates into a cutting edge and is directed inwardly towards the dispenser side fill entrance of the container.

The top wall 105 has a commodity discharge aperture 107 which is surrounded by an externally threaded spout 108 that is integrally formed with the top wall 105 and projects upwardly therefrom and is adapted to be engaged by an externally closure cap 109.

The general method of operation of the invention is somewhat similar to the previously described forms of the invention. The flexible commodity form-fill-seal plastic pouch 102 is inserted in the container, all openings to the container are closed, and the pouch and its contents are sealed therein. Coincidentally, the dispenser-cutter unit is brought into piercing contact with the pouch skin and tears a hole therethrough to allow the withdrawal of the commodity therefrom. The sealed container is ready for use, and when needed, the closure cap is removed from the spout, the container tilted and the commodity is poured out of the pouch and container. When the required volume of the commodity has been withdrawn, the spout is recapped by the closure cap and the container is put away in storage until further required.

In the above description of the invention, the container and the dispenser-cutter unit combination has been generally described for housing and utilizing a single flexible commodity form-fill-seal pouch at a time.

But the same general structure may house and utilize multiple flexible commodity form-fill-seal plastic pouches without difficulty, a demonstration of which is shown in FIG. 18.

In FIG. 18, the container 110 is formed of a rigid plastic or equivalent material and has a closed end 111 and an open end 112 and is provided with a vertical partition 113 integrally or otherwise secured to the inner surface of the container to form multiple-pouch compartments 114 therein. The closed integral end 111 of the container has a commodity discharge aperture 115 surrounded by an externally threaded dispenser spout 116 that is integral with the closed end 111 and projects upwardly therefrom and which is adapted to be engaged by an internally threaded closure screw cap 117.

The internally threaded closure screw cap 117 forms an integral part of the dispenser-cutter unit and which is in the form of a top-fill dispenser 118 controlled through a spray gun 119 and operated by compressed air or other means for withdrawing and spraying commodity contents from the container 110 and integrally mounted on the closure screw cap 117. Double-suction tubes 120 and 121 have their upper portions bent inwardly towards one another at 122 and 123 and merged together to form a hollow neck 124 which is in alignment with the commodity egress passageway 125 of a top-fill dispenser 118. The hollow neck 124 of the double-suction tubes 120 and 121 is integrally or otherwise secured to the top-fill dispenser 118 while the free portions 126 and 127 of the suction tubes terminate into pouch-knife cutting edges 128 and 129.

The lower portion 130 of the container 110 is externally threaded around its circumference and located adjacent to its circumferential edge forming the contour of the open end 112, and which is adapted to be engaged by the internally threaded lid 131.

The flexible commodity form-fill-seal plastic pouches are inserted through the open end of the container into their respective compartments and the threaded lid is applied to the open end of the container and interlocks the container and lid together into a tight closure position. The closure cap is removed from the spout of the closed end of the container and is replaced by the dispenser pouch-cutter unit by first aligning the dispenser with the spout and inserting the suction tubes of the pouch-cutter unit, that forms a part of the dispenser, into the respective pouch compartments for engagement and penetration of the multiple pouches contained therein. The threaded closure top of the dispenser is then brought into interlocking and tight engaging position with the spout of the container, thereby sealing the container, which is now ready for use. It will thus be seen that the pouch container and dispenser pouch-cutter unit combination is capable of being made in all sizes and to lend themselves for commercial and industrial purposes.

The invention, as a container-dispenser flexible commodity form-fill-seal plastic pouch cutter unit combination, is equally useful in its application for the internal mixing and metering of the constituents and their concentration, and their withdrawal from the container-dispenser-cutter unit.

In FIGS. 19, 20, 21 and 22 the container and dispenser-cutter unit combination consist of a container 132 made from a rigid plastic or equivalent material and shaped in the form of a bottle having an externally threaded open neck portion 133 and a bottom end wall 134. A curve-shaped partition 135 is integrally or otherwise secured to an innerside surface of the bottle wall 136 forming therewith a rigid open pocket 137 and situated adjacent to and partially under the interior area of the open-neck portion 133, the size of the open pocket 137 being predetermined in accordance to the pre-selected size and style of the flexible commodity form-fill-seal plastic pouches 138 that are to be used.

The dispenser-pouch-cutter 139, as illustrated, is in the form of an external mixing spray pump 140 for the internal mixing of the constituents which have been withdrawn and metered from the container, is integrally mounted on a screw cap 141 on which the base 142 of the pump 140 is integrally or otherwise mounted and secured and extends upwardly therefrom. The base 142, which may be hollow or solid, is provided with a commodity passageway 143 and a fluid tubular passageway 144 which merge or join with one another into a common commodity and fluid passageway 145 leading through the plunger spring mechanism compartment 146 and into the mixing chamber of the plunger head 147 and which is provided with the customary nozzles 148.

A commodity suction tube 149 and a diluter fluid suction tube 150 are integrally or otherwise secured to the base 142 and surround the entrances of the commodity passageway 143 and the fluid tubular passageway 144, and project downwardly through the screw cap 141 and therebeyond. The commodity suction tube 149 has its free end portion 151 terminating into a flexible pouch knife cutting edge 152 and adapted to be inserted into the open pouch pocket 137 of the container, while the diluter fluid suction tube 150 projects downwardly into the container and terminates short of the bottom thereof.

In the application and use of this form of the invention, the flexible form-fill-seal plastic pouch, which contains the concentrate, is inserted in an upright position in the open pouch pocket of the container and the remaining space in the container is filled with a diluent but which, preferably has a fluid level below the level of the open pouch pocket. The screw cap 141 of the dispenser pouch-cutter unit 139 is brought into interlocking engagement with the externally threaded open neck portion of the container and coincidentally the commodity suction tube 149 will enter the open pouch pocket of the container and pierce and penetrate into the flexible commodity form-fill-seal plastic pouch and remain therewithin. Simultaneously, the diluter fluid suction tube 150 enters the diluent provided in the lower portion of container 132. Regulation of metering valve 153 controls the volume of flow of the commodity which enters into and mixes with the diluent passing through the diluter fluid suction tube. The container-dispenser-cutter unit assembly is now completely sealed and ready for use.

Since certain changes may be made in the above invention and different embodiments of the invention could be made without departing from the scope thereof, it is intended that all matter contained in the above description or shown in the accompanying drawings shall be interpreted as illustrative and not in a limiting sense.

What I claim is:

1. In a container and a dispenser-cutter unit combination adapted to contain and hold a detachable flexible form-fill-seal plastic pouch containing fluids, granules and the like, a container having top and bottom walls and a dispenser side-fill entrance, a spout formed integrally with said top wall and projecting upwardly therefrom, a side hinged closure wall forming a part of said container and adapted to close and open the dispenser side-fill entrance, a dispenser pouch cutter forming an operative part of said container and projecting inwardly therein, and a closure cap for said spout, said dispenser pouch cutter being formed in a V-shaped knife secured to the inner surfaces of said container and the apex of said knife being directed toward said dispenser side-fill entrance of said container.

2. In a container and dispenser-cutter unit combination adapted to contain detachable flexible form-fill-seal plastic pouches containing fluids, granules and the like, a container having an opened end and a closed end, a vertical partition secured to the inner surface of said container and forming pouch compartments and adapted to contain individual plastic pouches therein, an externally threaded dispenser spout integrally formed in the closed end of said container and projecting upwardly therefrom, an internally threaded screw cap adapted to form a closure for said externally threaded spout, a dispenser-cutter unit integrally mounted on said internally threaded screw cap, combined suction and cutter tubes forming a unit and connected to and operated by said dispenser and adapted to be individually inserted into said individual pouch compartments in said container and penetrate into the individual flexible form-fill-seal plastic pouches contained therein, and an internally threaded lid forming a closure for the opened end of said container.

3. In a container and dispenser-cutter unit combination, as claimed in claim 2, in which said dispenser-cutter unit is in the form of a top-fill dispenser and a spray gun, said dispenser having a commodity egress passageway extending through said screw cap.

4. In a container and dispenser-cutter unit combination, as claimed in claim 3, in which a plurality of said suction tubes have their upper portions bent inwardly towards one another and merged together to form a hollow neck and which is in alignment with the commodity egress passageway of said top-fill dispenser and is integrally secured to said top-fill dispenser, said plurality of said suction tubes having their lower portions terminating into pouch knife cutting edges.

5. In a container and dispenser-cutter unit combination adapted to contain and hold a detachable flexible commodity form-fill-seal plastic pouch containing fluids, granules and the like, a container having an opened externally threaded neck portion and a bottom end wall, a curve-shaped partition integrally secured to an inner side surface of said container and forming therewith a rigid opened pocket situated adjacent to and partially extending under the interior area of the externally threaded neck portion, a screw cap forming a closure for the opened externally threaded neck portion, a dispenser-pouch cutter in the form of an external mixing spray pump integrally mounted on said screw cap and having a commodity tubular passageway and a diluter fluid tubular passageway, a commodity suction tube having one end secured to said dispenser and connected to the commodity tubular passageway thereof and its other end terminating into a pouch knife cutting edge and adapted to be inserted in the opened pocket of said container, a diluter fluid suction tube having one end secured to said dispenser and connected to the diluter fluid passageway and its remaining portion adapted to be inserted into that portion of the container containing the diluent, and a metering means forming a part of said dispenser.

* * * * *